US008359752B2

(12) United States Patent
Bridges

(10) Patent No.: US 8,359,752 B2
(45) Date of Patent: Jan. 29, 2013

(54) SHAVING RAZOR CARTRIDGE

(75) Inventor: Kelly Daniel Bridges, Abington, MA (US)

(73) Assignee: The Gillette Company, Boston, MA (US)

( * ) Notice: Subject to any disclaimer, the term of this patent is extended or adjusted under 35 U.S.C. 154(b) by 364 days.

(21) Appl. No.: 12/817,280

(22) Filed: Jun. 17, 2010

(65) Prior Publication Data

US 2011/0308089 A1 Dec. 22, 2011

(51) Int. Cl.
*B26B 21/22* (2006.01)

(52) U.S. Cl. ..... 30/50; 30/77; 30/84

(58) Field of Classification Search ..... 30/50, 84, 30/77

See application file for complete search history.

(56) References Cited

U.S. PATENT DOCUMENTS

| | | | | |
|---|---|---|---|---|
| 4,378,634 | A * | 4/1983 | Jacobson | 30/47 |
| 4,492,024 | A * | 1/1985 | Jacobson | 30/530 |
| 5,224,267 | A * | 7/1993 | Simms et al. | 30/50 |
| 5,313,706 | A * | 5/1994 | Motta et al. | 30/57 |
| 5,761,814 | A * | 6/1998 | Anderson et al. | 30/50 |
| 6,009,624 | A | 1/2000 | Apprille, Jr. et al. | |
| 6,044,542 | A * | 4/2000 | Apprille et al. | 29/525.05 |
| 6,397,473 | B1 | 6/2002 | Clark | |
| 6,601,303 | B2 * | 8/2003 | Gilder et al. | 30/50 |
| 7,100,284 | B2 | 9/2006 | King | |
| 7,331,107 | B2 * | 2/2008 | Follo et al. | 30/50 |
| 8,146,255 | B2 * | 4/2012 | Denkert et al. | 30/50 |
| 2004/0055156 | A1 * | 3/2004 | Brown, Jr. | 30/34.1 |
| 2006/0196054 | A1 * | 9/2006 | Luxton | 30/50 |
| 2006/0248726 | A1 | 11/2006 | Coffin | |
| 2009/0193659 | A1 | 8/2009 | Park et al. | |
| 2009/0288304 | A1 | 11/2009 | Denkert et al. | |
| 2009/0293281 | A1 | 12/2009 | Bruno | |
| 2010/0175265 | A1 | 7/2010 | Bozikis et al. | |
| 2011/0203120 | A1 * | 8/2011 | Witkus | 30/346.58 |
| 2011/0232101 | A1 * | 9/2011 | Park et al. | 30/50 |
| 2011/0308089 | A1 * | 12/2011 | Bridges | 30/77 |

OTHER PUBLICATIONS

PCT International Search Report with Written Opinion in corresponding Int'l appln. PCT/US2011/040273 dated Sep. 15, 2011.

* cited by examiner

*Primary Examiner* — Hwei C Payer

(74) *Attorney, Agent, or Firm* — John M. Lipchitz; Kevin C. Johnson; Steven W. Miller

(57) ABSTRACT

A wet shaving cartridge comprising with a housing having a guard, a cap, and a pair of spaced apart interior walls between the cap and the guard. A blade retention bump is positioned on at least one of the spaced apart interior walls. At least one resilient blade retention member extends laterally from one of the interior walls toward the other interior wall. At least one clip mounted to the housing. At least one blade is positioned between the resilient blade retention member and at least one of the interior walls. The blade is rigidly fixed in a first direction between the clip and the blade retention bumps and retained in a second direction between the resilient blade retention members and at least one of the interior walls.

20 Claims, 6 Drawing Sheets

SHAVING RAZOR CARTRIDGE

FIELD OF THE INVENTION

The present invention relates to shaving razor cartridges and more particularly to shaving cartridges that have a housing for retaining and/or rigidly fixing one or more blades.

BACKGROUND OF THE INVENTION

In general, shaving razors of the wet shave type include a cartridge or blade unit with at least one blade with a cutting edge which is moved across the surface of the skin being shaved by means of a handle to which the cartridge is attached. The cartridge may be mounted detachably on the handle to enable the cartridge to be replaced by a fresh cartridge when the blade sharpness has diminished to an unsatisfactory level, or it may be attached permanently to the handle with the intention that the entire razor be discarded when the blade or blades have become dulled (i.e., disposable razor). The connection of the cartridge to the handle provides a pivotal mounting of the cartridge with respect to the handle so that the cartridge angle adjusts to follow the contours of the surface being shaved. In such systems, the cartridge can be biased toward a rest position by the action of a spring-biased plunger (a cam follower) carried on the handle against a cam surface on the cartridge housing.

Razor cartridges usually include a guard which contacts the skin in front of the blade(s) and a cap for contacting the skin behind the blade(s) during shaving. The cap and guard aid in establishing the so-called "shaving geometry", i.e., the parameters which determine the blade orientation and position relative to the skin during shaving, which in turn have a strong influence on the shaving performance and efficacy of the razor. The cap and the guard may aid in establishing the exposure of the blades. Exposure may be defined as the position of the cutting edge of a blade relative to a tangent line drawn from the skin contacting element (e.g., a blade) in front of the cutting edge to the skin contacting element behind the cutting edge (e.g., the cap). A cutting edge positioned above the tangent line would have a positive exposure and a cutting edge positioned below this line would have a negative exposure. A cutting edge that lies on the tangent line has a neutral exposure. Another shaving parameter that significantly effects shave performance is known as span. Span may be defined as the distance from the cutting edge to a skin contacting element immediately in front of the cutting edge (e.g., another blade or the guard). Another parameter that may influence shaving performance is the blade angle. The blade angle is the angle of the cutting edge relative to the tangent line (described above).

SUMMARY OF THE INVENTION

In one aspect, the invention features, in general, a wet shaving cartridge having a housing with a guard, a cap, and a pair of spaced apart interior walls between the cap and the guard. A blade retention bump is positioned on at least one of the spaced apart interior walls. At least one resilient blade retention member extends laterally from one of the interior walls toward the other interior wall. At least one clip is mounted to the housing. At least one blade positioned between the resilient blade retention member and at least one of the interior walls wherein the blade is rigidly fixed in a first direction between the clip and the blade retention bumps and retained in a second direction between the resilient blade retention members and at least one of the interior walls.

In another aspect, the invention features, in general, a wet shaving cartridge housing having with a guard, a cap, a pair of spaced apart interior walls between the guard and the cap, and a resilient blade retention member having a fixed end extending from one of the interior walls and a free end extending transverse to the fixed end. The free end and one of the interior walls define a blade slot having a width. The resilient blade retention member deflects from a first position to a second position to receive a blade. The width of the blade slot in the first position is less than the width of the blade slot in the second position.

In yet another aspect, the invention features, in general, a wet shaving cartridge having a housing with a guard, a cap, a pair of spaced apart interior walls between the cap and the guard, and a blade retention bump having a top surface with a radius of about 0.1 mm to about 0.5 mm positioned on at least one of the interior walls. At least one clip is mounted to the housing and least one blade is positioned between the spaced apart interior walls. The blade is rigidly fixed in a first position between the clip and the top surface of the blade retention bump. The wet shaving cartridge may optionally include a resilient blade retention member having a fixed end extending from one of the interior walls and a free end extending transverse to the fixed end. The free end and at least one of the interior walls defines a blade slot having a width. The resilient blade retention members deflect from a first position to a second position. The width of the blade slot in the first position is less than the width of the blade slot in the second position to receive the blade.

The details of one or more embodiments of the invention are set forth in the accompanying drawings and the description below. Other features and advantages of the invention will be apparent from the description and drawings, and from the claims.

DETAILED DESCRIPTION OF THE INVENTION

Figure 1:
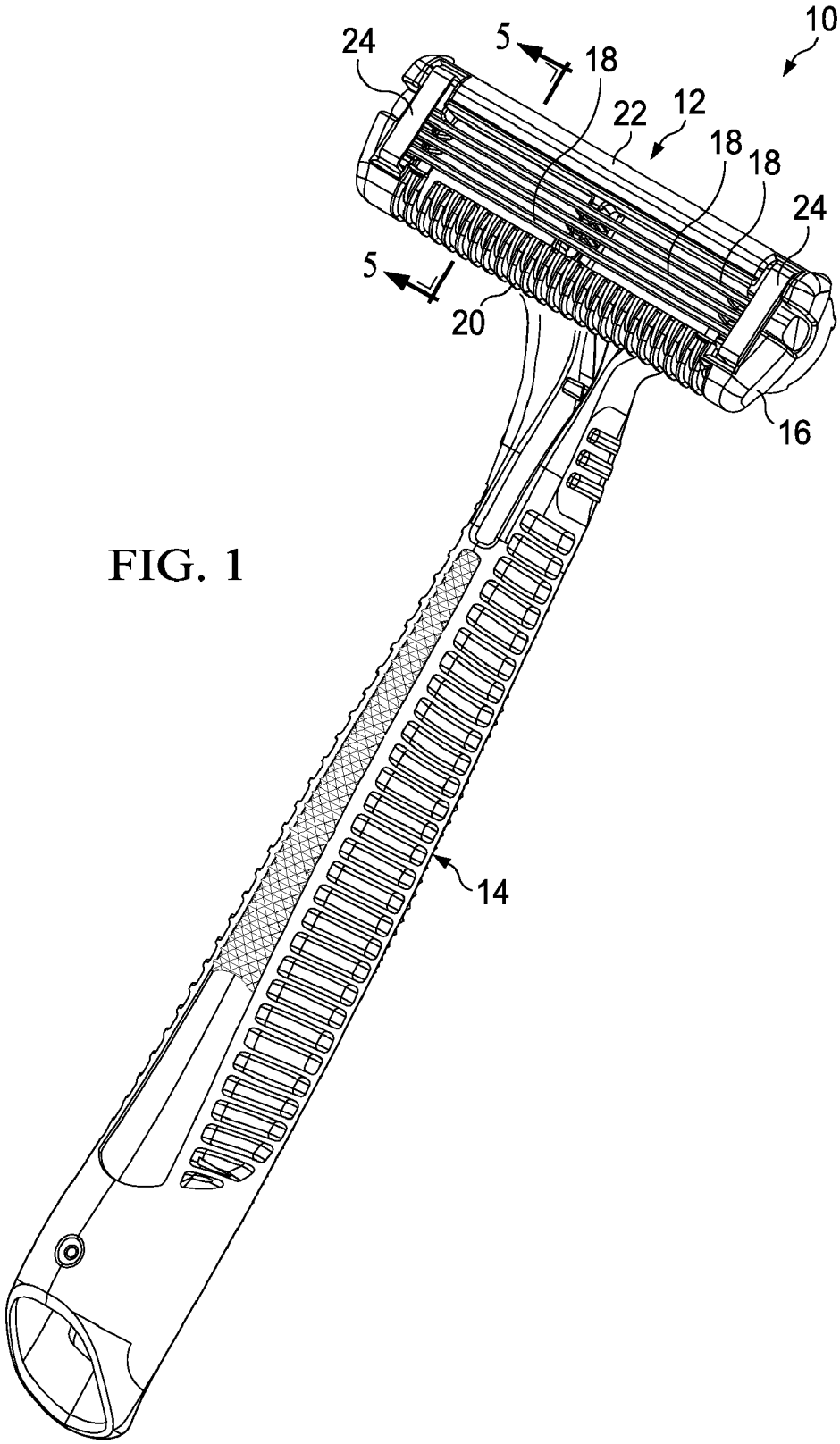
FIG. 1 is a perspective view of a shaving razor.

Referring to FIG. 1, one embodiment of the present disclosure is shown illustrating a shaving razor 10 having a shaving cartridge 12 mounted to a shaving razor handle 14. The shaving cartridge 12 may be pivotably (i.e., rotation of the cartridge 12 about an axis relative to the shaving razor handle 14) and/or detachably engaged to the shaving razor handle 14. The shaving cartridge 12 may include a housing 16 dimensioned to receive at least one blade 18. Although three blades 18 are shown, the housing 16 may have more or fewer blades depending on the desired performance and cost of the shaving razor 10. The blades 18 may be rigidly fixed to the housing 16 such that the blades 18 do not move relative to the housing 16 during a shaving stroke. The housing 16 may have a guard 20 in front of the blades 18 and a cap 22 behind the blades 18. The guard 20 and the cap 22 may aid in establishing a proper shaving geometry (e.g., blade exposure) for the shaving cartridge 12. The blades 18 may be mounted to the housing 16 and secured in at least one direction by at least one clip 24. For example, two clips 24 may be bent over the blades 18 and around at least a portion of the housing 16 to secure the blades 18 within the housing 16. Although the clips 24 are shown as two separate components fixing the blades 18 within the housing 16, the clips 24 may also be a single piece design. In addition, the clips 24 may not necessarily be bent or formed around a portion of the housing 16 to fix the blades 18 relative to the housing 16. For example, the clips 24 may be snapped fit, press fit, glued, or ultrasonically welded to the housing 16 to rigidly fix the clips 24 to the housing 16. The clips 24 may comprise a metal (e.g., aluminum or stainless steel) or a polymeric material (e.g., Noryl™ (a blend of polyphenylene oxide (PPO) and polystyrene developed by General Electric Plastics, now SABIC Innovative Plastics), acrylonitrile butadiene styrene (ABS), acetal, polypropylene, high impact polystyrene, or any combinations thereof.

The housing 16 and the shaving razor handle 14 may be injection molded from a semi-rigid polymeric material. In certain embodiments, the housing 16 and/or the shaving razor handle 14 may be molded from Noryl™ (a blend of polyphenylene oxide (PPO) and polystyrene developed by General Electric Plastics, now SABIC Innovative Plastics). The housing 16 and/or the shaving razor handle 14 may be molded from other semi-rigid polymers having a Shore A hardness of about 60 to 140, including, but not limited to acrylonitrile butadiene styrene (ABS), acetal, polypropylene, high impact polystyrene, or any combinations thereof. The guard 20 may be molded from the same material as the housing 16 or a softer material. For example, the guard 20 may be molded from materials having a shore A hardness of about 20 to about 70, such as thermoplastic elastomers (TPEs) or rubbers. The cap 22 may also be molded from the same material as the housing 16. In certain embodiments, the cap 22 may have an elongated strip containing a shaving aid to provide lubrication to the surface of the skin during shaving.

Figure 2:
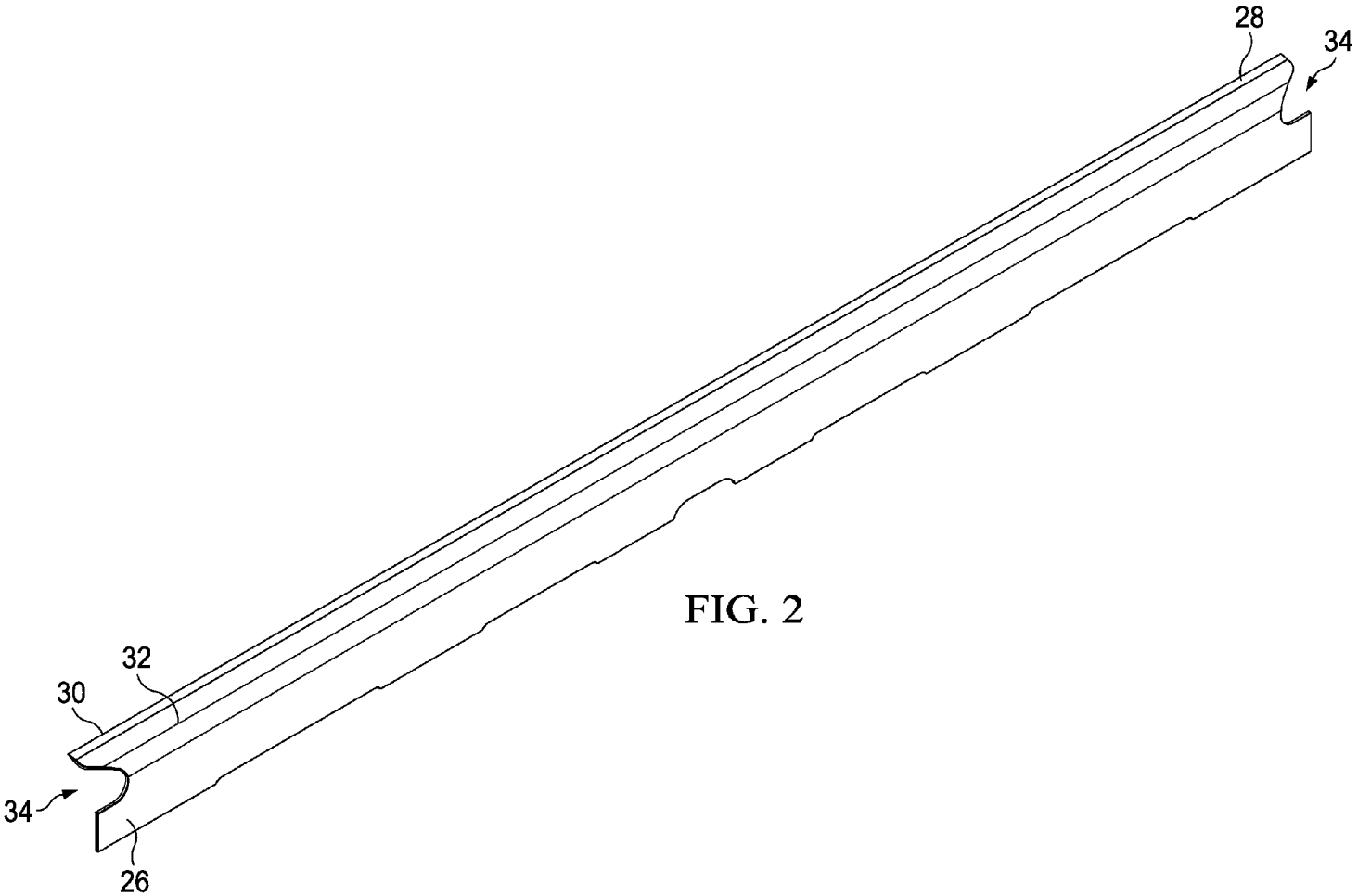
FIG. 2 is a perspective view of a blade of a cartridge of FIG. 1.

Referring to FIG. 2, a perspective view of one of the blades 18 is shown. The blades 18 may integrally formed from a single piece of material that is bent and sharpened either prior to bending or after bending. In most instances, the material is selected from the group of materials consisting of stainless steel, aluminum, ceramic, glass, plastic, and combinations thereof. The material may be bent using any suitable means known for the particular material being bent. The blades 18 may have an elongated support portion 26 along one lengthwise side, a tapered portion 28, along an opposing lengthwise side, narrowing to a sharpened cutting edge 30, and a bent portion 32 disposed between the elongated support portion 26 and the tapered portion 28. The manufacturing process may result in a notch 34 located on opposing ends of the blade 18 between the support portion 26 and the tapered portion 28. The notch may aid in transporting the blade during the assembly process. The elongated support portion 26 may have a thickness of about 0.075 mm, 0.085 mm, or 0.095 mm to about 0.105 mm, 0.115 mm, or 0.127 mm. The thickness of the elongated support portion 26 may provide for a sufficient inner bend radius of the bent portion 32. Relative to the elongated support portion 26, the tapered portion 28 may extend at an angle of about 90 degrees, 95 degrees, or 100 degrees to about 105 degrees, about 110 to about 115 degrees). The cutting edge 30 of the tapered portion 28 may have a wedge-shaped configuration with an ultimate tip having a radius less than about 1000 angstroms (e.g., about 100 angstroms, 150 angstroms, or 200 angstroms to about 500 angstroms, 700 angstroms, or 950 angstroms). An advantage of the disclosed bent razor blades 18 having a bent portion 32 is that it can be used in a razor cartridge as an alternative to a planar razor blade mounted on a thicker bent blade support. The bent razor blades 18 may facilitate improved rinsing of the cartridge 12 (see FIG. 1).

Figure 3:
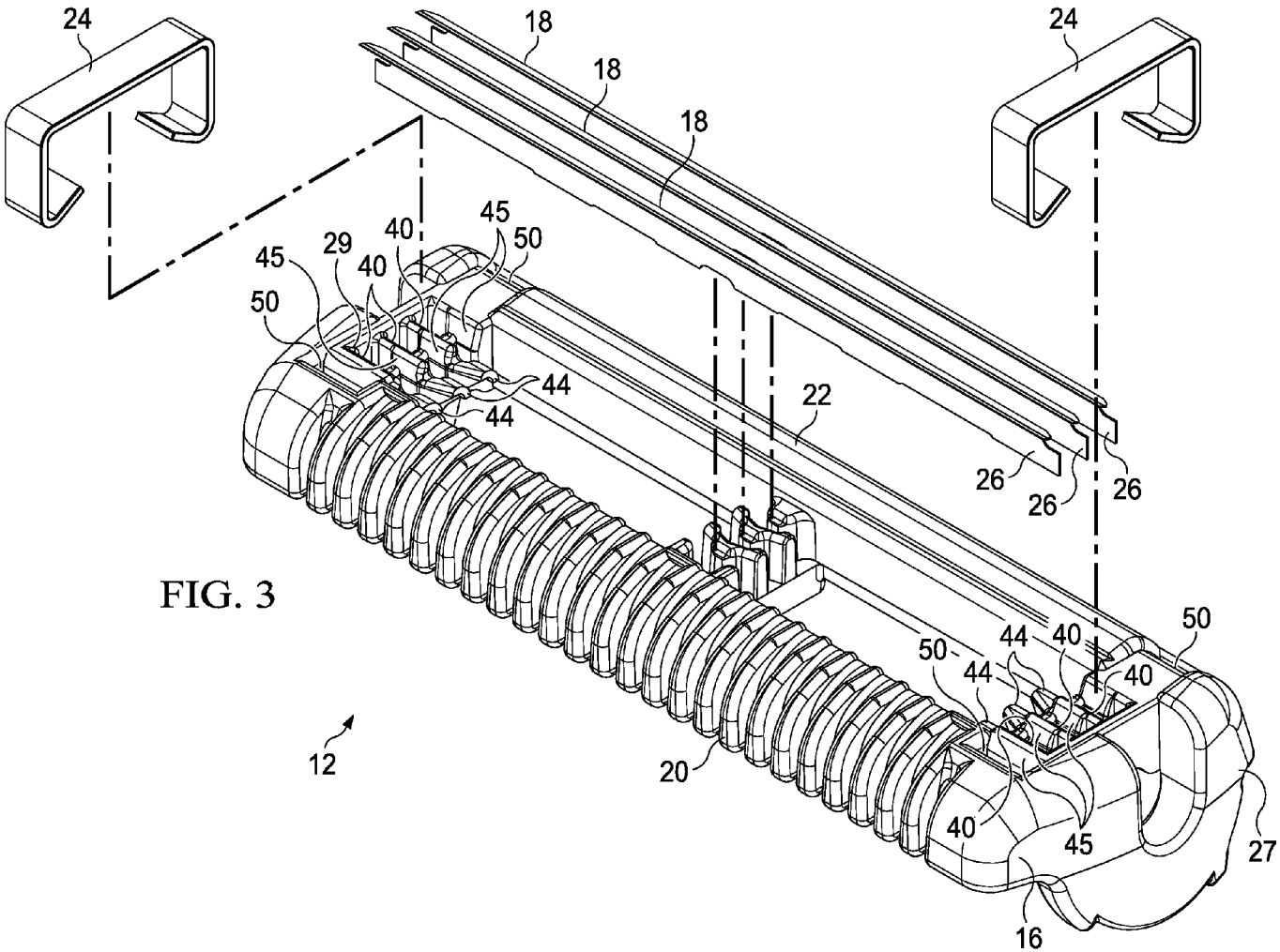
FIG. 3 is an exploded perspective view of the cartridge of the shaving razor of FIG. 1.

Referring to FIG. 3, an exploded perspective view of the cartridge 12 is shown. The housing 16 may have a pair of side walls 27 and 29 that are spaced apart from each other and are located between the guard 20 and the cap 22. One or more spaced apart interior walls (e.g., front interior walls 40 and rear interior walls 45) may project inwardly from each of the side walls 27 and 29. At least one of the interior walls (e.g., the rear interior walls 45) may taper downward and toward the guard 20 (or cap 22) to provide a lead-in for the blades 18 during assembly. One or more resilient blade retention members 44 may extend laterally inward from at least one of the interior walls (e.g., the front interior walls 40). The resilient blade retention members may extend longitudinally along the housing 16 (e.g., parallel to the blades 18). The resilient blade retention members 44 may also be laterally offset from at least one of the interior walls (e.g., the rear interior walls 45) to provide more space within the housing 16 for the resilient blade retention members 44. In certain embodiments, the resilient blade retention members 44 may be molded from high impact polystyrene to facilitate the flexing of the retention members 44 during assembly of the blades 18. Alternatively, Noryl™ may be used if increased strength and performance is required to prevent failure of the retention members 44 during assembly of the blades 18. The blades 18 may be mounted to the housing 16 by inserting the elongated support portion 26 of one of the blades 18 between one of front interior walls 40 and one of the rear interior walls 45. As will be described in greater detail below, the resilient blade retention members 44 may facilitate holding one or more of the blades 18 in place during shaving and assembly. Once the blades 18 are properly positioned between the respective front and rear interior walls 40 and 45, the clips 24 may be inserted into a pair of openings 50 that extends through the housing 16. The clips 24 may then be bent around a bottom portion of the housing 16 to rigidly fix the blades 18 and the clips 24 to the housing 16.

Figure 4A:
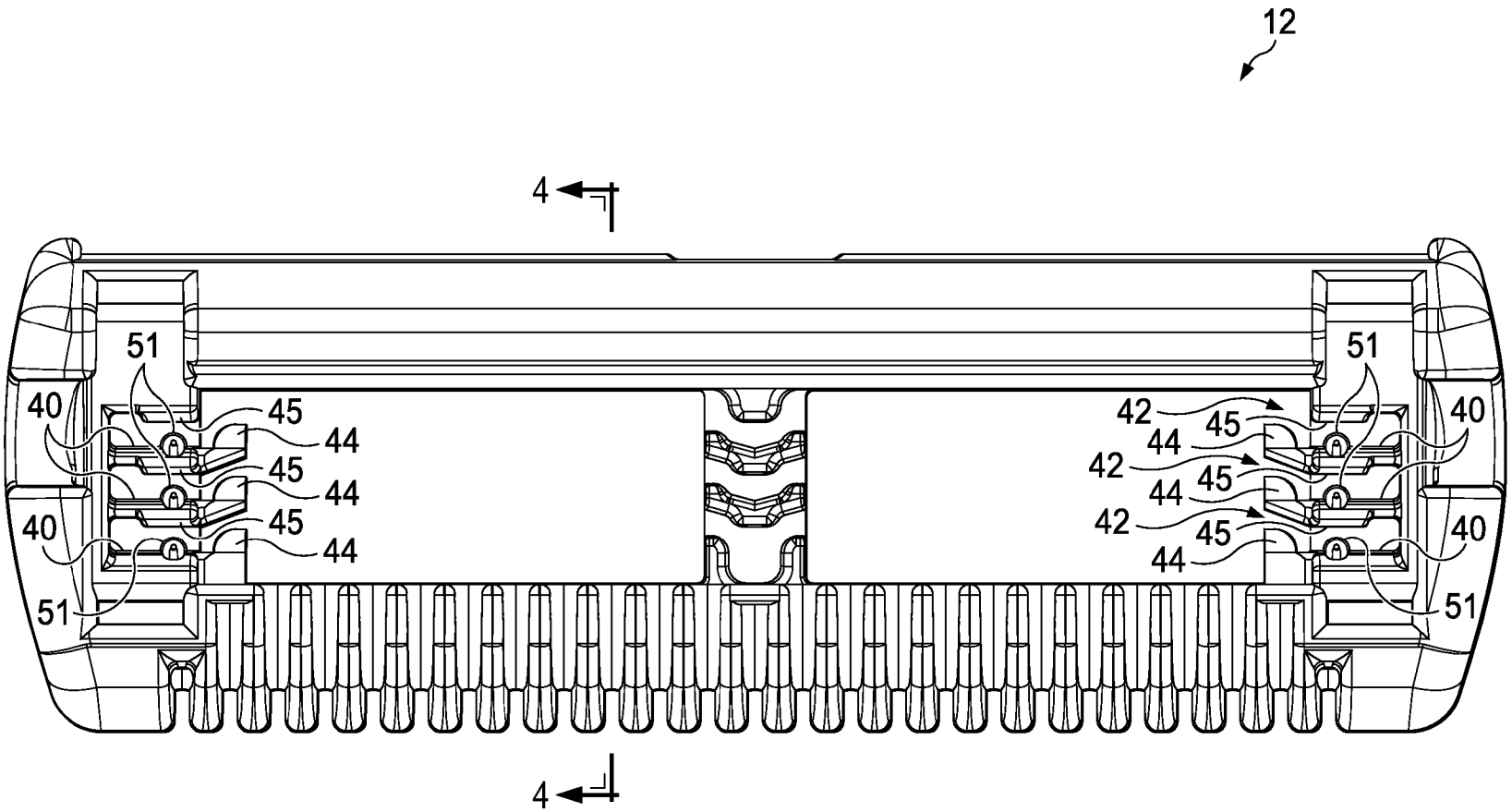
FIG. 4A is top view of a housing of the cartridge of FIG. 3.
Figure 4B:
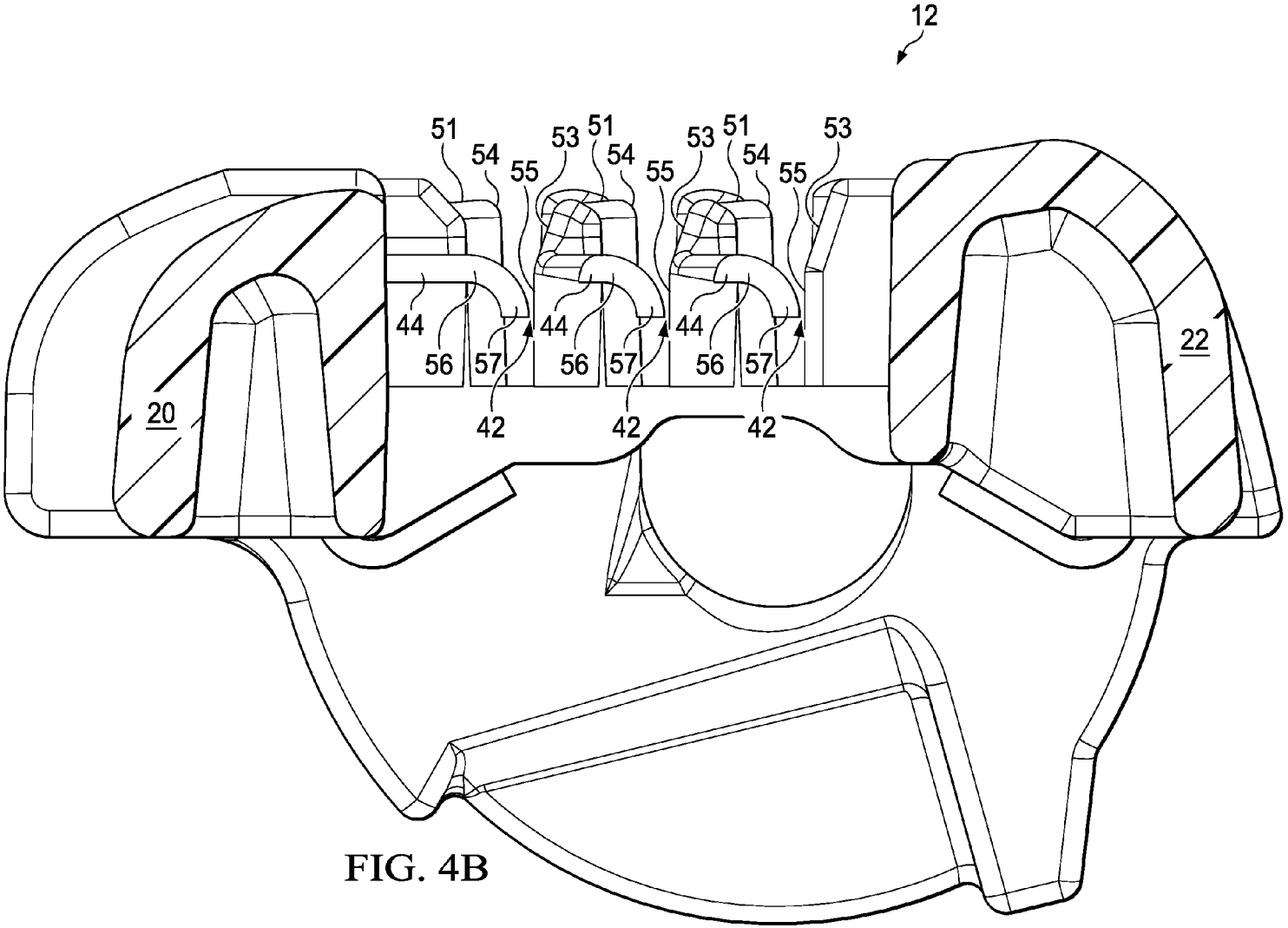
FIG. 4B is a section view of the housing of FIG. 4A, taken generally along the line 4-4, of FIG. 4A.

Referring to FIGS. 4A and 4B, a top view and a section view of the housing 16 are shown, respectively. One or more blade retention bumps 51 may be positioned on at least one of the interior walls (e.g., the front and rear interior walls 40 and 45). The blade retention bump 51 may extend between the front and rear interior walls 40 and 45. In certain embodiments, the blade retention bump 51 may be positioned on the front interior wall 40 and spaced apart from the respective rear interior wall 45. However, it is understood that the blade retention bump 51 may be positioned on the rear interior wall 45 and spaced apart from the respective the front interior wall 40. The blade retention bump 51 may have an arcuate top surface 54 (as shown in FIG. 4B) with a radius of about 0.1 mm, 0.15 mm, or 0.2 mm to about 0.3 mm, 0.4 mm, or 0.5 mm. In certain embodiments, the resilient blade retention members 44 may be spaced apart from the rear interior walls 45. The resilient blade retention members 44 may have a fixed end 56 extending from each of the front interior walls 40. As best shown in FIG. 4A, a free end 57 may extend in a transverse direction from the respective fixed end 56 toward the cap 22. The free end 57 of the resilient blade retention member 44 and the respective interior wall (e.g., the rear interior wall 45) may define a blade slot 42 having a width there between dimensioned to receive one or more blades 18 (not shown). The width of the blades slots 42 may be equal to or less than the thickness of the elongated support portion 26 of the blades 18 (e.g., about 0.0762 mm, 0.1 mm, or 0.178 mm to about 0.254 mm, 0.33 mm, or 0.381 mm) to hold the blades 18 in place during assembly of the blades 18 and/or during shaving. The resilient blade retention members 44 (e.g., the free end 57) may deflect from a first position (e.g., prior to assembly) to a second position (e.g., during assembly of the blades) to receive and/or retain the blade 18. In certain embodiments, the width of the blade slot 42 in the first position may be less than the width of the blade slot in the second position. Once the blades 18 are properly positioned within the respective blade slots 42, the retention member 44 may flex back towards its original position to retain the blade 18 in place. The free end 57 may be unsupported to facilitate flexing of the resilient blade retention members 44 as the blades 18 are inserted into the housing 16 during assembly. The rear interior walls 45 may have a tapered lead-in portion 53 and a straight portion 55. The tapered lead-in portion 53 may guide the elongated support potion 26 of the blades 18 (not shown) between the straight portion 55 of the rear interior wall and the resilient blade retention member 44. The free end 57 may be arcuate and/or extend away from the top surface 54 of the blade retention bumps 51 and toward the cap 22 to facilitate guiding of the blade 18. For example, if the blade contacts the free end 57, the geometry of the free end 57 may redirect the blade 18 between the straight portion 55 of the rear interior wall 45 and the resilient blade retention member 44.

Figure 5:
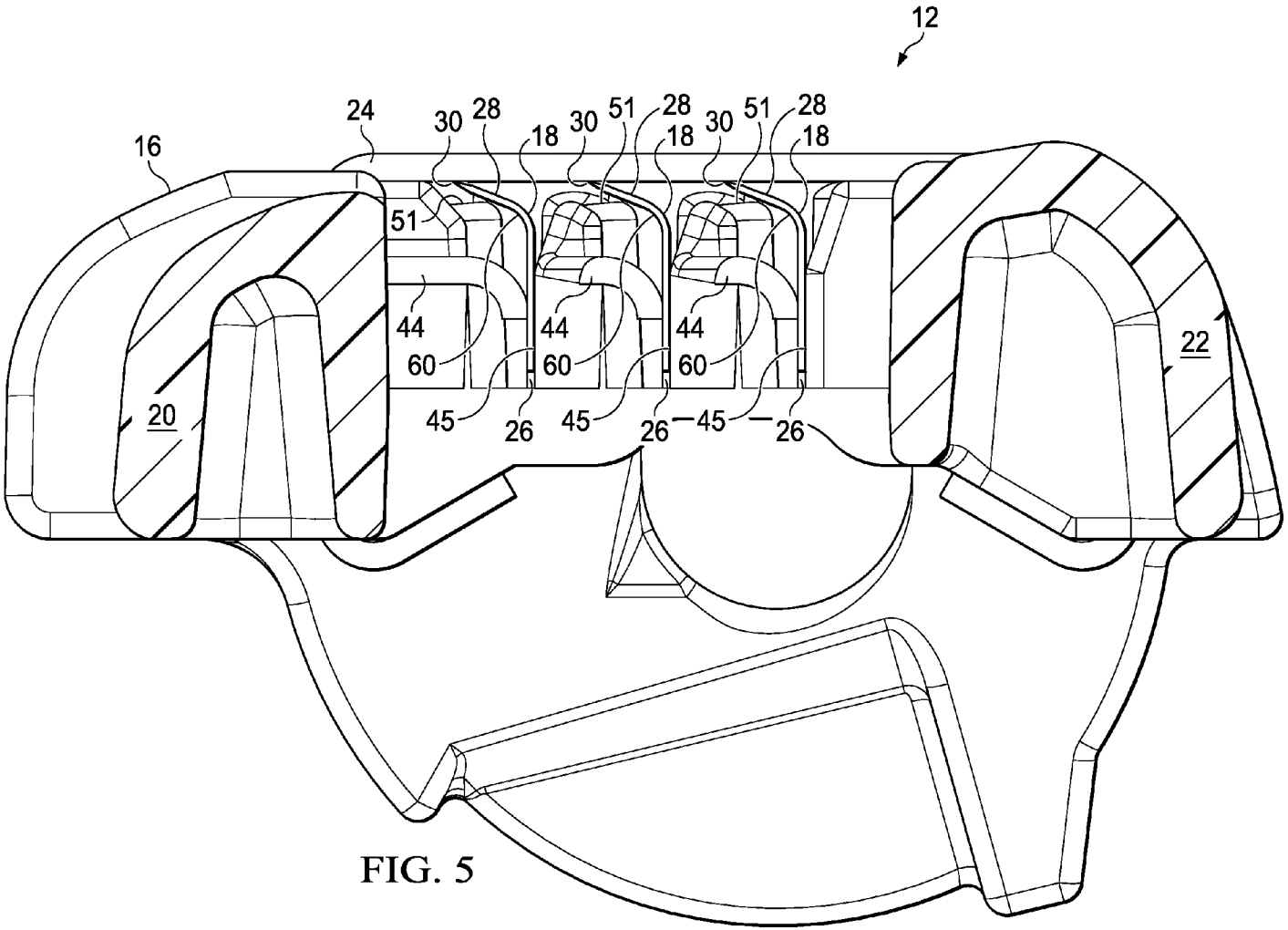
FIG. 5 is a section view of the cartridge of FIG. 1, taken generally along the line 5-5 of FIG. 1.

Referring to FIG. 5, a section view of the cartridge 12 is shown, taken generally along the line 5-5 of FIG. 1. The free end 56 (see FIG. 4B) of the resilient blade retention members 44 may extend away from the clips 24 and toward the respective rear interior walls 45 to guide the blades 18 into the blade slots 42 during assembly. The taper of the lead-in portion 53 (see FIG. 4B) of the rear interior walls 45 may also guide the blades 18 into the blade slots 42. The resilient blade retention members 44 provide ease of assembly of the blades 18 into the housing 16 and hold the blades 18 in place prior to the clips 24 being mounted and secured to the housing 16. Another possible advantage of the resilient blade retention members 44 is that damage to the blades 18 and/or the housing 16 may be minimized during assembly. For example, when a blade 18 is inserted into the housing 16, the resilient blade retention members 44 flex, which prevents the blade 18 from skiving the plastic housing 16 and/or damaging the blades 18. The dimensional tolerance for the thickness of the elongated supports 26 of the blades 18 and the width of the blade slots 42 do not have to be as stringent because the resilient blade retention members are able to flex, thus allowing the blade slots 42 to widen and receive the elongated supports 26 of the blades 18. If the thickness of the elongated supports 26 is too large and/or the width of the blade slots 42 is too small, the housing 16 may be skived or the blade 18 may become damaged during assembly. Conversely, if the thickness of the elongated supports 26 is too small and/or the width of the blade slots 42 is too large, the blades may rock within the blade slots 42 (e.g., toward the cap 22 and guard 20) during assembly and/or during shaving. In addition, if the blades 18 are not held properly in place during assembly, the clip 24 may secure the blades at an incorrect angle, thus negatively affecting shave performance (e.g., blade exposure or blade angle). If the blades rock within the blades slots 42, the shave performance may also negatively impacted.

The blades 18 may be mounted within the housing 16 such that the elongated support portion 26 does not bottom out against the housing 16. The length of the blades 18 prior to bending from the cutting edge 30 to the end of the elongated support portion 26 may be highly variable. Since the dimensions related to the tapered portion 28 and the bent portion 32 have a greater effect shave performance these dimensions have tighter tolerances than the length of the elongated support portion 26. Accordingly, elongated support portion 26 may not bottom out within the housing 16 because the tapered portion 28 of the blades 18 are rigidly fixed to the housing 16 between the clips 24 and the blade retention bumps 51. If the elongated support portion 26 bottomed out within the housing 16, the cartridge 12 may not have the desired blade exposure.

In certain embodiments, the blades 18 may be retained within the housing 16 in a first direction between the clips 24 and the blade retention bumps 51. The blades 18 may also be retained within the housing 16 in a second direction, which is different than the first direction. For example, the blades may be retained between the resilient blade retention members 44 and the rear interior walls 45. The first direction may be transverse to the second direction. For example, the first direction may be relative to the top and bottom of the cartridge 12 and the second direction may be relative to the front (e.g., the guard 24) and rear of the cartridge 12 (e.g., cap 22). The blade retention bumps 51 may be fixed relative to the housing 16 (e.g., the cap 22 and the guard 20) to prevent movement of the blades 18 during shaving. The blades 18 may be rigidly fixed in the first direction between the clips 24 and the blade retention bumps 51 such that the blades 18 do not move in an up and down direction during a shaving stroke. However, it is understood that the blade retention bumps 51 and the clips 24 may apply enough pressure against the blades 18 to restrict movement of the blades 18 in any direction under normal shaving conditions. An inner surface 60 of the tapered portion 28 of the blade 18 may directly contact the blade retention bumps 51 (i.e., the top surface 54, as shown in FIG. 4B). In certain embodiments, the tapered portion 28 (i.e., the inner surface 60) may be tangent to the retention bump 51 (i.e., the top surface 54) to provide for line contact between the tapered portion 28 and the retention bump 51. Furthermore, the retention bump 51 may have a full radius to provide point contact with the tapered portion 28 of the blade. One potential advantage of point or line contact between the blade 18 (i.e., tapered portion 28) and the housing 16 (i.e., retention bump 51) is that the height and angle of the blades 18 may be more accurate when the blade 18 is fixed in place by the clips 24. Accordingly, deformation of the blades 18 is minimized when the clips 24 are rigidly fixed to the housing 16, resulting in the cartridge 12 having a more consistent blade 18 geometry (e.g., exposure and blade angle).

An inner surface 60 of the tapered portion 28 of the blade 18 may directly contact the blade retention bumps 51 (i.e., the top surface 54). The radius of the blade retention bumps 51 may facilitate the tapered portion 28 to contact the blade retention bumps 51 (i.e., the top surface 54) at a tangent, which may securely fix the blade 18 in place without damaging the blade 18. Bent razor blades may be more susceptible to damage during assembly because of their decreased thickness compared to razor blades that are mounted on blade supports. However, it is understood that the housing 16 may be used for either bent blades or blades that are mounted on thicker blade supports. The tapered portion 28 of the blade 18 may directly contact the clips 24. In certain embodiments, the blade retention bumps 51 may directly contact only the tapered portion 28 and/or the cutting edge 30 of the blade (e.g., not the elongated support portion 26). The blade retention bumps 51 may be spaced apart from the elongated support portion 26 of the blade 16 to improve the flow of water through the cartridge for removing hair and shaving debris. In certain embodiments, the cutting edge 30 of the blade 18 may extend beyond the retention bump 51, but may not extend to the bent portion 32 and/or the elongated support portion 26 of the immediately forward (toward the guard 20) adjacent blade 18. For example, the retention bump 51 that contacts the blade 18 closest to the cap 22 (i.e., the third blade) may be spaced apart from the rear interior wall 45 that contacts the middle blade 18 (i.e., the second blade). Similarly, the retention bump 51 that contacts the middle blade 18 (second blade) may be spaced apart from the rear interior wall 45 that contacts the first blade 18 that is closest to the guard 20. One possible advantage of the spacing of the blade retention bumps 51 and the rear interior walls 45 may be improved rinsing between the blades 18 because the blades 18 are positioned with the cutting edges 30 not overlapping any portion of the preceding blade 18.

It is understood that certain embodiments may include both the blade retention bump 51 and the resilient blade retention member 44. Other embodiments may include either the blade retention bump 51 or the resilient blade retention member 44. In all embodiments, the blade retention bump 51 may be positioned on either the front and/or the rear interior walls 40 and 45. In all embodiments, the resilient blade retention member 44 may extend from either the front and/or the rear interior walls 40 and 45.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A wet shaving cartridge comprising:
a housing having
a guard;
a cap;
a pair of spaced apart interior walls between the cap and the guard;
a blade retention bump on at least one of the spaced apart interior walls;
at least one resilient blade retention member extending laterally from one of the interior walls toward the other interior wall,
at least one clip mounted to the housing; and
at least one blade positioned between the resilient blade retention member and at least one of the interior walls wherein the blade is rigidly fixed in a first direction between the clip and the blade retention bump and retained in a second direction between the resilient blade retention member and at least one of the interior walls.

2. The wet shaving cartridge of claim 1 wherein the pair of spaced apart interior walls includes a rear interior wall and a front interior wall, and the resilient blade retention member extends laterally from the rear interior wall.

3. The wet shaving cartridge of claim 1 wherein the pair of spaced apart interior walls includes a rear interior wall and a front interior wall, and the retention bump is on the front interior wall.

4. The wet shaving cartridge of claim 1 wherein the resilient blade retention member has an arcuate top surface.

5. The wet shaving cartridge of claim 1 wherein the retention bump is spaced apart from the resilient blade retention member.

6. The wet shaving cartridge of claim 1 wherein at least one of the interior walls tapers downward and toward the guard.

7. The wet shaving cartridge of claim 1 wherein the resilient blade retention member has a fixed end extending laterally from one of the interior walls and a free end extending transverse to the fixed end.

8. The wet shaving cartridge of claim 1 wherein the blade has an elongated support portion, a tapered portion having a cutting edge, and a bent portion between the elongated support portion and the tapered portion.

9. The wet shaving cartridge of claim 8 wherein the resilient blade retention members contact only the elongated support portion of the blade.

10. The wet shaving cartridge of claim 8 wherein the retention bump has a top surface that directly contacts the tapered portion of the blade.

11. The wet shaving cartridge of claim 8 wherein the elongated support portion of the blade is spaced apart from the retention bump.

12. A wet shaving cartridge housing comprising:
a guard;
a cap;
a pair of spaced apart interior walls between the guard and the cap; and
a resilient blade retention member having a fixed end extending from one of the interior walls and a free end extending transverse to the fixed end, the free end and one of the interior walls defining a blade slot having a width, wherein the resilient blade retention member deflects from a first position to a second position to receive a blade and the width of the blade slot in the first position is less than the width of the blade slot in the second position.

13. The wet shaving cartridge housing of claim 12 wherein the fixed end of the resilient blade retention member extends laterally from at least one of the interior walls.

14. The wet shaving cartridge housing of claim 12 wherein the resilient blade retention member has an arcuate top surface.

15. The wet shaving cartridge housing of claim 12 wherein the pair of spaced apart interior walls includes a front interior wall and a rear interior wall, and the resilient blade retention member extends laterally from the rear interior wall and toward the cap.

16. A wet shaving cartridge comprising:
a housing having
a guard;
a cap;
a pair of spaced apart interior walls between the cap and the guard,
a blade retention bump having a top surface with a radius of about 0.1 mm to about 0.5 mm positioned on at least one of the interior walls,
at least one clip mounted to the housing; and at least one blade positioned between the spaced apart interior walls wherein the blade is rigidly fixed in a first position between the clip and the top surface of the blade retention bump.

17. The wet shaving cartridge of claim 16 wherein the retention bumps have a full round radius.

18. The wet shaving cartridge of claim 16 wherein the clip is formed around the housing.

19. The wet shaving cartridge of claim 16 further comprising a resilient blade retention member having a fixed end extending from at least one of the interior walls and a free end extending transverse to the fixed end, one of the interior walls and the resilient blade retention member define a blade slot having a width, wherein the resilient blade retention members deflect from a first position to a second position and the width of the blade slot in the first position is less than the width of the blade slot in the second position.

20. The wet shaving cartridge of claim 16 wherein the blade has an elongated support portion spaced apart from the retention bump, a cutting portion directly contacting the top surface of the retention bump, and a bent portion between the elongated support portion and the cutting portion.

* * * * *